US008229338B2

(12) United States Patent
Nanataki et al.

(10) Patent No.: US 8,229,338 B2
(45) Date of Patent: Jul. 24, 2012

(54) IMAGE FIXING APPARATUS

(75) Inventors: Hideo Nanataki, Yokohama (JP); Kenji Takagi, Mishima (JP); Keisuke Mitsuhashi, Suntou-gun (JP); Noritomo Yamaguchi, Suntou-gun (JP); Terutaka Endo, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 247 days.

(21) Appl. No.: 12/708,890

(22) Filed: Feb. 19, 2010

(65) Prior Publication Data

US 2010/0232849 A1 Sep. 16, 2010

(30) Foreign Application Priority Data

Mar. 12, 2009 (JP) ..... 2009-059557

(51) Int. Cl.
*G03G 15/20* (2006.01)

(52) U.S. Cl. ..... 399/327

(58) Field of Classification Search ..... 399/327
See application file for complete search history.

(56) References Cited

U.S. PATENT DOCUMENTS 4,393,804 A 7/1983 Nygard et al.

FOREIGN PATENT DOCUMENTS

| | | | |
|---|---|---|---|
| JP | S58-088771 | | 5/1983 |
| JP | H08-220921 | | 8/1996 |
| JP | 2001-042687 | | 2/2001 |
| JP | 2002-189374 | | 7/2002 |
| JP | 3364555 | | 1/2003 |
| JP | 2006065230 A | * | 3/2006 |
| JP | 2006-220888 | | 8/2006 |

OTHER PUBLICATIONS

Chinese Office Action dated Jun. 16, 2011, in counterpart Chinese Application No. 201010135285.1, and English-language translation thereof.

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

The image fixing apparatus forms a cleaning nip portion by pressing a web roll-up portion on a fixing rotation member with a feeding roller, a used portion for cleaning of the web is fed from a cleaning nip portion formation area, and during non-cleaning, a roller is at a waiting position at which the roller is farther from the fixing rotation member than its position during cleaning so as to separate the web roll-up portion from the fixing rotation member. Accordingly, it is possible to reduce degradation of a cleaning ability due to a toner component held by the used portion of the cleaning web.

9 Claims, 11 Drawing Sheets

IMAGE FIXING APPARATUS

BACKGROUND OF THE INVENTION

1. Field of the Invention

The present invention relates to an image fixing apparatus for fixing a toner image onto a recording medium by heating the recording medium and the toner thereon.

2. Description of the Related Art

In an image fixing apparatus mounted in a copy machine or a printer using an electrophotographic recording technique, a fixing rotation member for forming a fixing nip portion of the image fixing apparatus gets dirty due to a toner component which is not fixed onto a recording medium. Therefore, a device for cleaning the fixing rotation member by bringing a web in contact with a peripheral surface of the fixing rotation member to wipe off the toner component adhered to the peripheral surface of the fixing rotation member with the web has been utilized.

In Japanese Patent Application Laid-Open No. H08-220921, an image fixing apparatus which stretches a web (cleaning web 16) wound around a supplying roller (feeding roller 25) over a winding roller (press rolling roller 26) is described. In this technique, since the winding roller itself also serves as a contact roller and presses a fixing rotation member (heating roller 12) with the web to form a cleaning nip portion, cleaning of the fixing rotation member can be performed only by the winding roller and the supplying roller. During the cleaning, the winding roller is rotated to draw an unused portion for cleaning of the web into the cleaning nip portion and roll up a used portion for cleaning around a peripheral surface of the winding roller.

Although heating of the fixing rotation member performed by a heating member (heater 11) is stopped, the fixing rotation member does not immediately cool. Therefore, as long as the winding roller is pressed by the fixing rotation member with the web, the web near the cleaning nip portion is in the state of being heated by the fixing rotation member for a while even after the heating is stopped. Since the used portion for cleaning of the web is rolled up around the winding roller, the used portion for cleaning of the web is layered in the vicinity of the cleaning nip portion and nipped between the fixing rotation member and the winding roller. Accordingly, in the vicinity of the cleaning nip portion after the heating is stopped, a toner component inside the web of a layer (surface layer) which comes in contact with the fixing rotation member is in a high-fluidity state. Moreover, even a toner component that hardens inside the web of a layer (lower layer) which is closer to a peripheral surface of the winding roller than the surface layer becomes softened. This is because a time for heat remaining in the fixing rotation member to transfer to the web of the lower layer is shorter than a time for the fixing rotation member to cool to a temperature at which fluidity of the toner component is sufficiently decreased. As a result, in the vicinity of the cleaning nip portion which is pressed, the toner component held between the web of the surface layer and the web of the lower layer is exuded, thereby degrading a cleaning ability of the web.

Furthermore, in a case where the apparatus is configured so that the supplying roller whose peripheral surface is rolled with the unused portion for cleaning of the web also serves as the contact roller, only the web of the surface layer holds the toner component therein in the vicinity of the cleaning nip portion, and the unused portion for cleaning of the web of the lower layers other than the surface layer are overlapped. Therefore, in the vicinity of the cleaning nip portion after the heating is stopped, the toner component inside the web of the surface layer that comes in contact with the fixing rotation member is in the high-fluidity state, so that the toner component permeates and flows into the unused cleaning web of the lower layers, thereby degrading the cleaning ability of the web.

SUMMARY OF THE INVENTION

In order to solve the above-mentioned problem, an object of the invention is to provide an image fixing apparatus for preventing the degradation of a cleaning ability of a web due to a toner component held by a used portion for cleaning of the web. A purpose of the present invention is to provide an image fixing apparatus for fixing an unfixed toner image formed on a recording medium, including a fixing rotation member that forms a fixing nip portion through which the recording medium passes, and a roller having a peripheral surface around which the web is wound. The roller forms a cleaning nip portion for cleaning the fixing rotation member with the web by pressing a portion on which a web is winded up, against the fixing rotation member. A used portion for cleaning of the web moves from the cleaning nip portion by rotation of the roller, and during non-cleaning in which the web does not clean the fixing rotation member, the roller leaves the fixing rotation member so that it is farther from the fixing rotation member than when it is at a position during cleaning so that the web separates from the fixing rotation member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
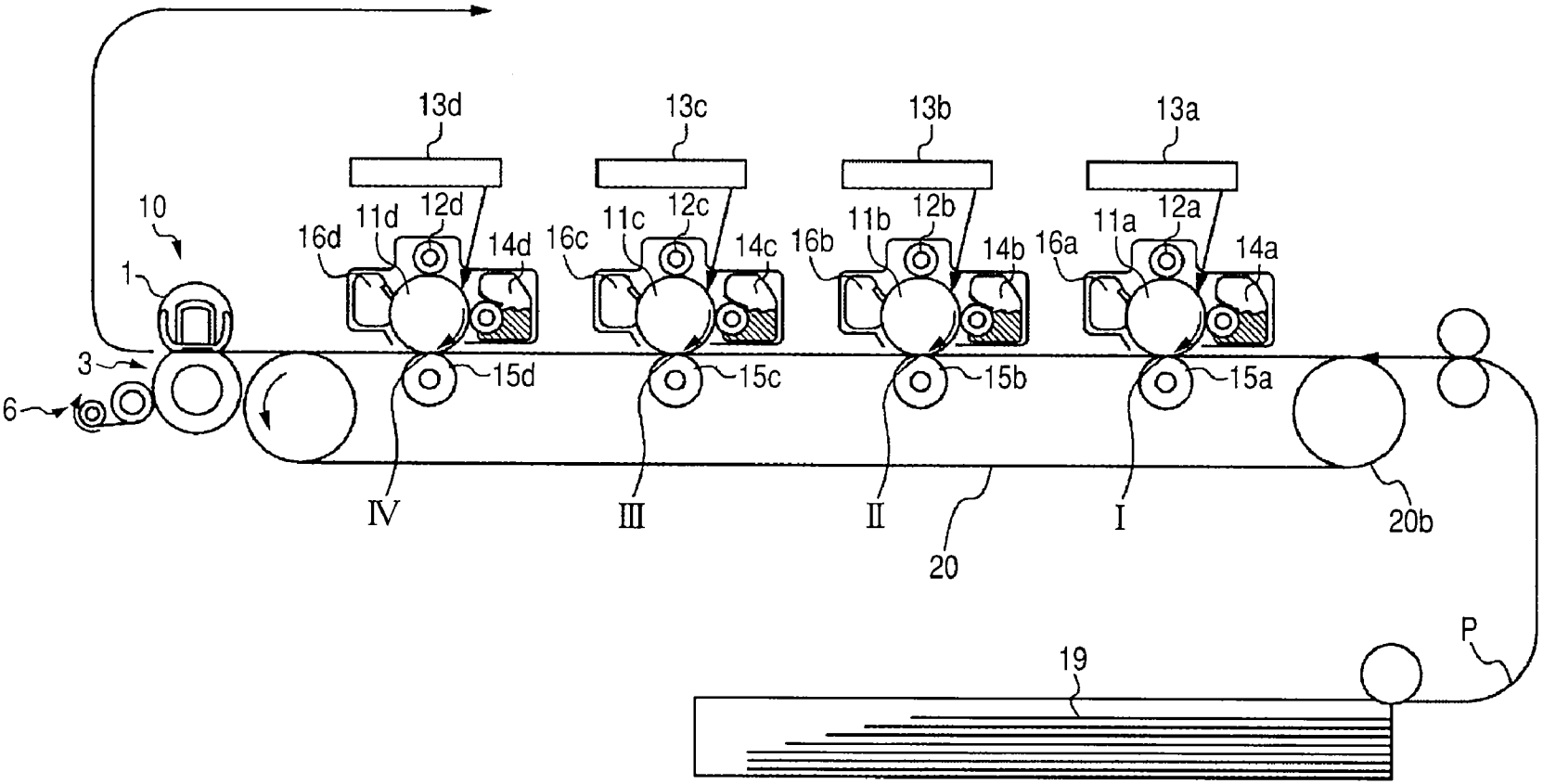
FIG. 1 is a sectional view illustrating an image forming apparatus which uses an image fixing apparatus according to the invention in a recording medium transport direction.

Hereinafter, exemplary embodiments of the invention will be described in detail. An image fixing apparatus of the invention is used for, for example, an image forming apparatus as illustrated in FIG. 1 to fix a toner image onto a recording medium by applying heat and pressure to the recording medium and the toner image formed on the recording image. FIG. 1 is a sectional view illustrating an image forming apparatus which uses an image fixing apparatus 10 of the invention in a recording medium transport direction. As photosensitive drums of the image forming apparatus, photosensitive drums 11*a* to 11*d* corresponding to yellow, magenta, cyan, and black colors, respectively. A transfer belt 20 is nipped between the photosensitive drums 11*a* to 11*d* and transfer rollers 15*a* to 15*d* to form transfer nip portions I to IV.

Image Forming Operation

An image forming operation for forming a toner image using the image forming apparatus, transferring the toner image onto a recording medium P such as paper, and performing a fixing operation thereby obtaining a fixed image will be described.

As the photosensitive drum 11*a* is rotated in arrowed directions (clockwise in the figures), a surface of the photosensitive drum 11*a* is uniformly charged by a charger 12*a*. Next, a latent image is formed on the surface by laser light emitted from a scanner 13*a*, and a toner image is formed on the surface of the photosensitive drum 11*a* by a developer 14*a*. For multi-color image formation, similarly, on the surfaces of the photosensitive drums 11*b* to 11*d* corresponding to the respective colors, toner images corresponding to the respective colors are formed. The recording medium P is fed from a recording medium tray 19 and transported on the transfer belt 20. The toner image on the photosensitive drum 11*a* is transferred onto the recording medium P in a transfer nip portion I configured by the photosensitive drum 11*a* and the transfer roller 15*a*. For multi-color image formation, similarly, as the recording medium P passes through transfer nip portions II to IV, toner images are sequentially transferred from the photosensitive drums 11*b* to 11*d*. On the other hand, toner remaining on the photosensitive drums 11*a* to 11*d* after passing through the transfer nip portions Ito IV is scraped off by cleaners 16*a* to 16*d* so as to be collected.

An operation of fixing a toner image onto a recording medium by applying heat and pressure to the recording medium P and the toner image using the image fixing apparatus 10 according to an embodiment of the invention to obtain a fixed image (fixing operation) will be described.

Figure 2:
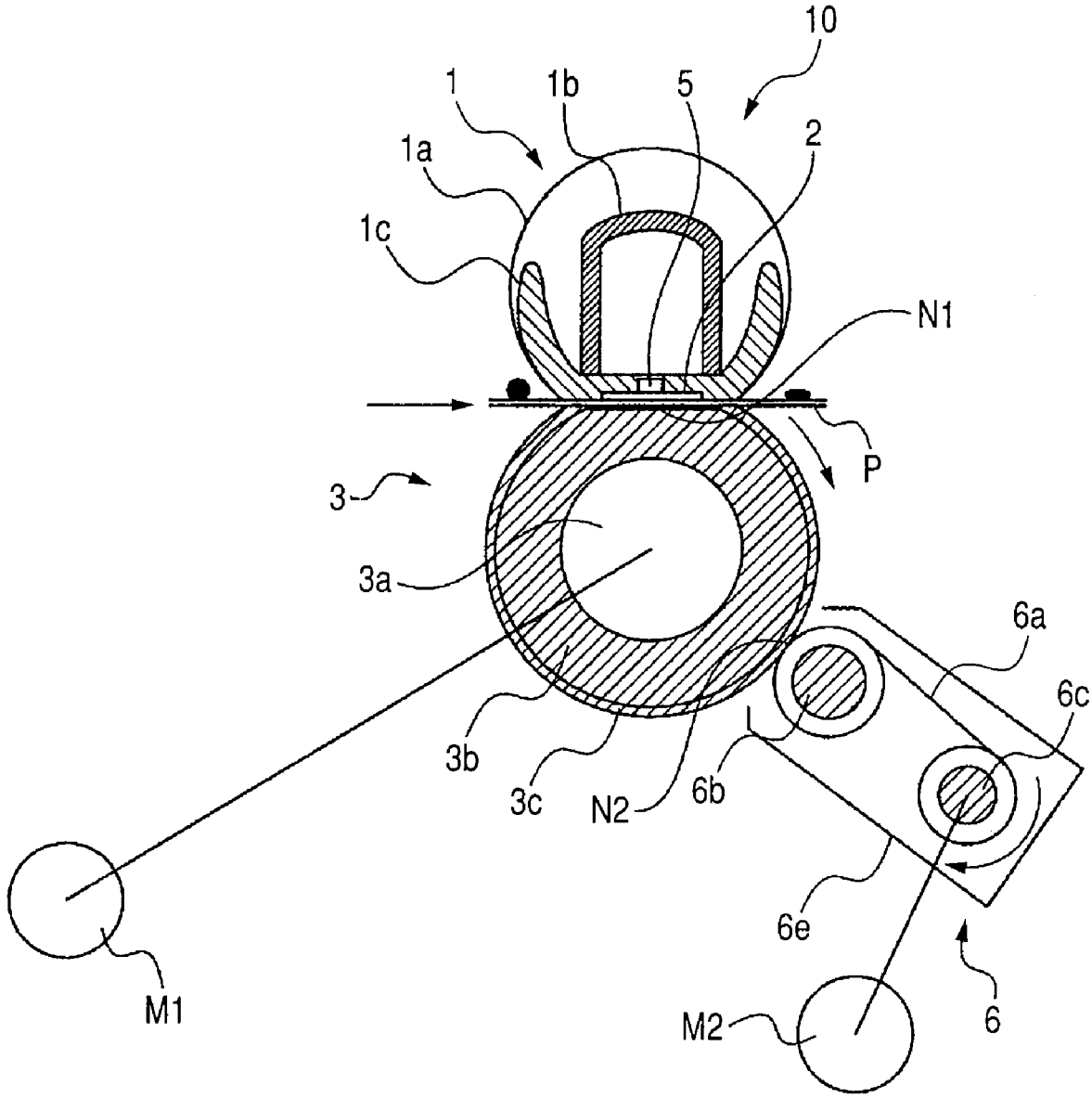
FIG. 2 is a sectional view illustrating the image fixing apparatus according to the invention in the recording medium transport direction.

FIG. 2 is a sectional view illustrating the image fixing apparatus 10 in the recording-medium transport direction. A heating unit 1 includes a heater 2 (heating element), such as a ceramic heater, and a flexible heating film 1*a* (fixing film) which is fitted to a periphery of a heater holder 1*c* for supplying the heater 2, and is supported and fixed by a supporting stay 1*b*. The heating film 1*a* is a cylindrical film configured by forming a releasing material layer, made of a material such as PTFE, on a metal film, such as a stainless steel, and the releasing material layer comes in pressing contact with an unfixed toner image bearing surface of the recording medium P. A pressure roller 3 (fixing rotation member) is an elastic roller without a heat source therein and configured by providing a rubber layer 3*b* made of such as silicon rubber on a metal core rod 3*a* made of such as stainless steel and coating a releasing material layer 3*c* made of a material, such as PFA, on the rubber layer 3*b*. A fixing nip portion N1 is formed by nipping the heating film 1*a* between the pressure roller 3 and the ceramic heater 2. The pressure roller 3 is driven by a motor M1 to be rotated clockwise in FIG. 2. While the pressure roller 3 is driven by the motor M1 to be rotated clockwise in FIG. 2, the heating film 1*a* is driven to be rotated while abutting on the heater 2 by the friction in the fixing nip portion N1. The temperature of the fixing nip portion is controlled based on a sensed temperature of a temperature sensor 5.

The recording medium P is separated from the transfer belt and transported to the image fixing apparatus 10 and introduced to the fixing nip portion N1 between the heating film 1*a* and the pressure roller 3. The recording medium P passes through the fixing nip portion N1 while being pressed onto an outer peripheral surface of the heating film 1*a* by the pressure roller 3. Here, the toner image is heated and fused by thermal conduction from the heating film 1*a* so as to be fixed onto the recording medium P, thereby obtaining a fixed image. The image forming operation is completed at this time.

When the fixing operation is performed, a small amount of toner component that cannot be fixed to the recording medium P adheres to the heating film 1*a* at the fixing nip portion N1. In addition, after the recording medium P passes through the fixing nip portion N1, the toner component adhering to the heating film 1*a* is returned to the fixing nip portion N1 as the heating film 1*a* is rotated, and is transmitted to the pressure roller 3 that is at a lower temperature than the heating film 1*a* so as to pollute the roller surface. Furthermore, when borderless printing is performed, there may be a case where the toner component adhering to the recording medium P directly pollutes the surface of the pressure roller 3 while the recording medium P passes through the fixing nip portion N1. The image fixing apparatus 10 of the invention includes a cleaning unit 6 for cleaning the toner component on a side of the pressure roller 3. For the image fixing apparatus 10, besides the film-heating type, a roller-heating type, an external-heating type, or the like may be used. Embodiments of the image fixing apparatus 10 having the film heating type will be described.

Embodiment 1

Configuration of Cleaning Unit

Figure 3:
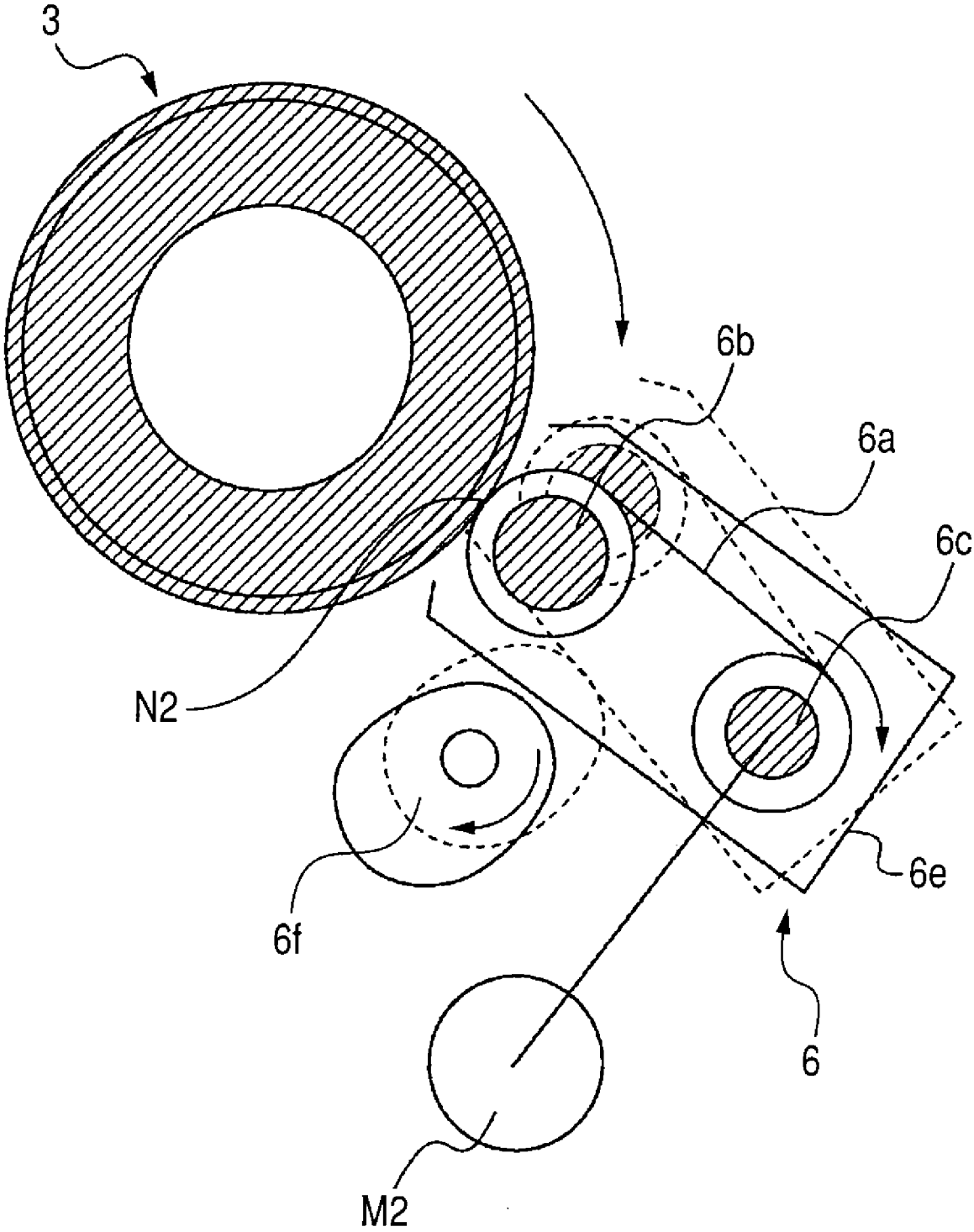
FIG. 3 is a sectional view illustrating a cleaning unit of the image fixing apparatus according to Embodiment 1.

FIG. 3 is a sectional view illustrating the cleaning unit 6 of the image fixing apparatus 10 according to Embodiment 1. The cleaning unit 6 includes a web 6*a*, a supplying roller 6*b*, which is a rotation member around which an unused portion for cleaning of the web 6*a* is wound (rolled) up in advance, and a winding roller 6*c*, which is a rotation member for winding a used portion of the web 6*a* for cleaning of the web 6*a*. For easy replacement, the supplying roller 6*b*, the winding roller 6*c*, and the web 6*a* are integrally supported by a frame member 6*e* to configure the cleaning unit.

The web 6*a* is formed by pressing fiber made of PPS resin into a thin cloth shape by calendar processing to solidify PPS resin, and has a thickness of 40 μm, a dimension of lengthxwidth=2m×224 mm, and a weight (weight used per unit area) of 40 g/m$^2$. As a material of the web 6*a*, besides the PPS, fiber, one of a polyester resin, an aramid resin, and a rayon, adjusted to have a weight of 20 to 60 g/m$^2$, and processed into a thin nonwoven or woven fabric, may be used.

The thickness thereof may be in the range of 20 to 70 μm. However, different materials, dimensions, and thicknesses may be used as long as they do not produce an undesirably low strength for cleaning the pressure roller 3.

In addition, the image fixing apparatus 10 rotates the heating film 1*a* using the frictional force between the image fixing apparatus 10 and the pressure roller 3. Therefore, so as not to cause slipping, which may occur when friction between the heating film 1*a* and the pressure roller 3 is reduced due to a lubricant in the fixing nip portion N1, the web 6*a* employs a dry web that does not need lubricant.

Cleaning of Fixing Apparatus

Next, cleaning of the image fixing apparatus 10 will be described. According to the invention, cleaning of the image fixing apparatus 10 is performed by wiping the surface of the pressure roller 3 with the web 6*a* of the cleaning unit 6. According to this embodiment, the supplying roller 6*b* also serves as a contact roller. Specifically, by biasing the supplying roller 6*b* toward the pressure roller 3 with a force of 20 to 40 N, a cleaning nip portion N2 of about 2 mm is formed between the supplying roller 6*b* and the pressure roller 3 with the web 6*a* wound around the supplying roller 6*b* nipped therebetween. In addition, the cleaning is performed in the cleaning nip portion N2 by wiping the toner component or paper powder adhering to the pressure roller 3 so as to hold the toner component or paper powder between the fibers of the web 6*a*.

After the toner component adhering to the heating film 1*a* is transmitted to the pressure roller 3 from the heating film 1*a* using a temperature gradient created in the fixing nip portion N1 (between papers) when the recording medium P does not pass through the fixing nip portion N1, the cleaning operation is performed.

The winding roller 6*c* is driven to be rotated by a motor M2 via an idle gear G (not illustrated) in a dashed arrow direction to wind the web by a length of about 50 μm for a fixing operation corresponding to one side of one sheet of an A4-size recording medium (called a one-sheet fixing operation). The web of the cleaning nip portion N2 is renewed by winding the web in a cleaning nip portion N2 formation area so as to be moved by about 50 μm for the one-sheet fixing operation, so that degradation of the cleaning capability thereof due to saturation of the held toner component can be prevented. Until the unused portion for cleaning of the web 6*a* that is input to the cleaning nip portion N2 formation area (in this embodiment, about 2 mm) from an upstream winding direction comes out of the nip portion N2 at the downstream side thereof as the used portion for cleaning, a fixing operation corresponding to one side of 40 sheets of the A4-size recording media (40-sheet fixing operation) can be performed. In order for the supplying roller 6*b* not to feed an excess amount of the web due to vibration of the apparatus, a slight braking force is provided by pressing a leaf spring (not illustrated) to a rotation shaft of the supplying roller 6*b*. With regard to a winding timing, like winding of about 50 μm at a time after finishing the one-sheet fixing operation or slow winding of about 50 μm with the one-sheet fixing operation, any speed and any timing can be employed as long as the web is wound according to the fixing operation so as not to degrade the cleaning ability thereof. A length of web to be wound per each one-sheet fixing operation may be determined as an optimal length in consideration of a thickness and a material of the web, contamination of the image fixing apparatus, and the surroundings.

Separation Mechanism

The image fixing apparatus 10 has a separation mechanism for separating the pressure roller 3 and the web 6*a* rolled up around the supplying roller 6*b* from each other. By the separation mechanism, permeating of the toner component from the surface layer to the lower layer of the web 6*a* rolled up around the supplying roller 6*b* can be reduced.

First, permeating of the toner component between layers of the rolled-up web is described with reference to Experiments 1 and 2. In addition, a web, a roller rolled with the web, and a pressure roller used for Experiments 1 and 2 were the same as those used for the image fixing apparatus 10.

Experiment 1

In this experiment, in a state where the cleaning nip portion N2 is formed while the heating operation of the heater 2 is turned off after terminating the fixing operation of the image fixing apparatus 10, the temperature of the web 6*a* near the cleaning nip portion N2 was measured. Winding of the web was not performed.

Figure 4:
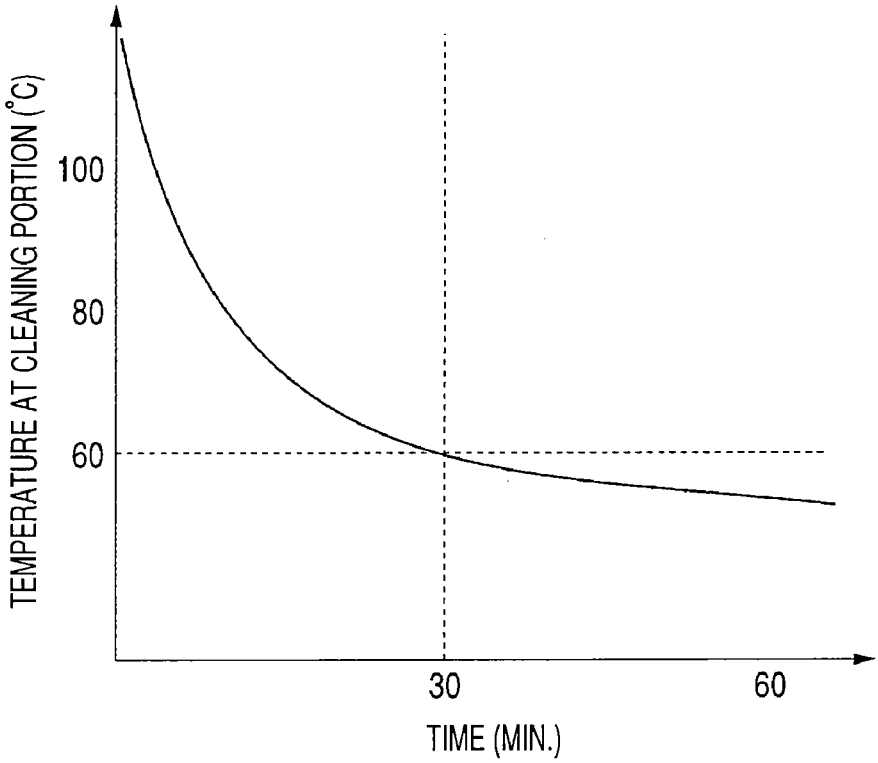
FIG. 4 is a diagram illustrating a relationship between an elapsed time (minute) and a temperature of a cleaning nip portion N2.

FIG. 4 is a graph plotting a time-varying temperature from the start of the measurement. The heating temperature due to the heater 2 at the fixing nip portion N1 during the fixing operation was about 180° C., and the temperature of the cleaning nip portion N2 at that time was about 120° C. Accordingly, the temperature of the web at the time of starting the measurement was about 120° C. and was decreased to about 60° C. for 30 minutes.

Experiment 2

In this experiment, two sheets of the web were pressed by a pressing force of 30N by overlapping the unused cleaning web that does not hold the toner component with the web that holds the toner component, and the amount of the toner component permeating into the unused cleaning web was measured. Permeation amounts in cases where the temperature of the used cleaning web was maintained at 60° C., 80° C., and 100° C. were measured.

Figure 5:
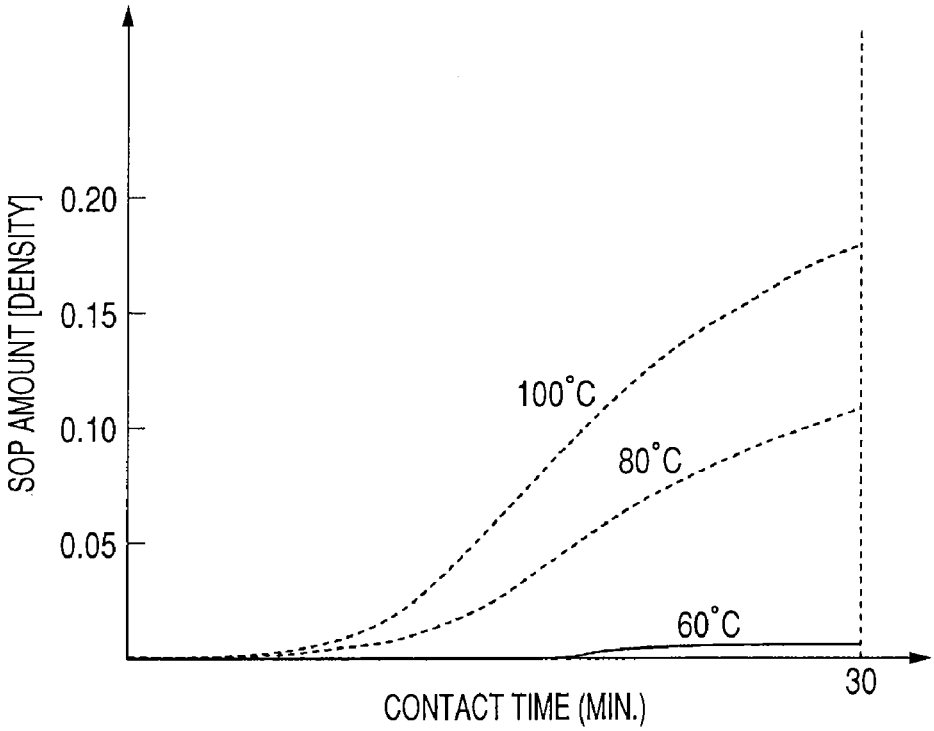
FIG. 5 illustrates a relationship between a contact time (minute) and a permeation amount.

FIG. 5 is a graph plotting a change in a permeation amount for 30 minutes from the start of the measurement. In FIG. 5, the "permeation amount" uses a reflection density (OD value) of the toner component permeating into the unused cleaning web as an index. As the OD value increased, a density of the toner component permeating into the web increased, which means a greater permeation amount. In this figure, the higher the temperature is, the more permeation amount of the toner component increases. This result relates to a glass-transition temperature of the toner component. The glass-transition temperature means that softening of the toner component significantly progresses at a temperature equal to or higher than the glass-transition temperature and fluidity of the toner component increases. For a general toner component, the glass-transition temperature is around 80° C. Accordingly, in this experiment, in the case of 60° C. that is lower than the glass-transition temperature, permeating rarely occurred. However, in the cases of 80° C. and 100° C., which are higher than the glass-transition temperature, permeating occurred, and permeation had progressed with time.

Figure 6:
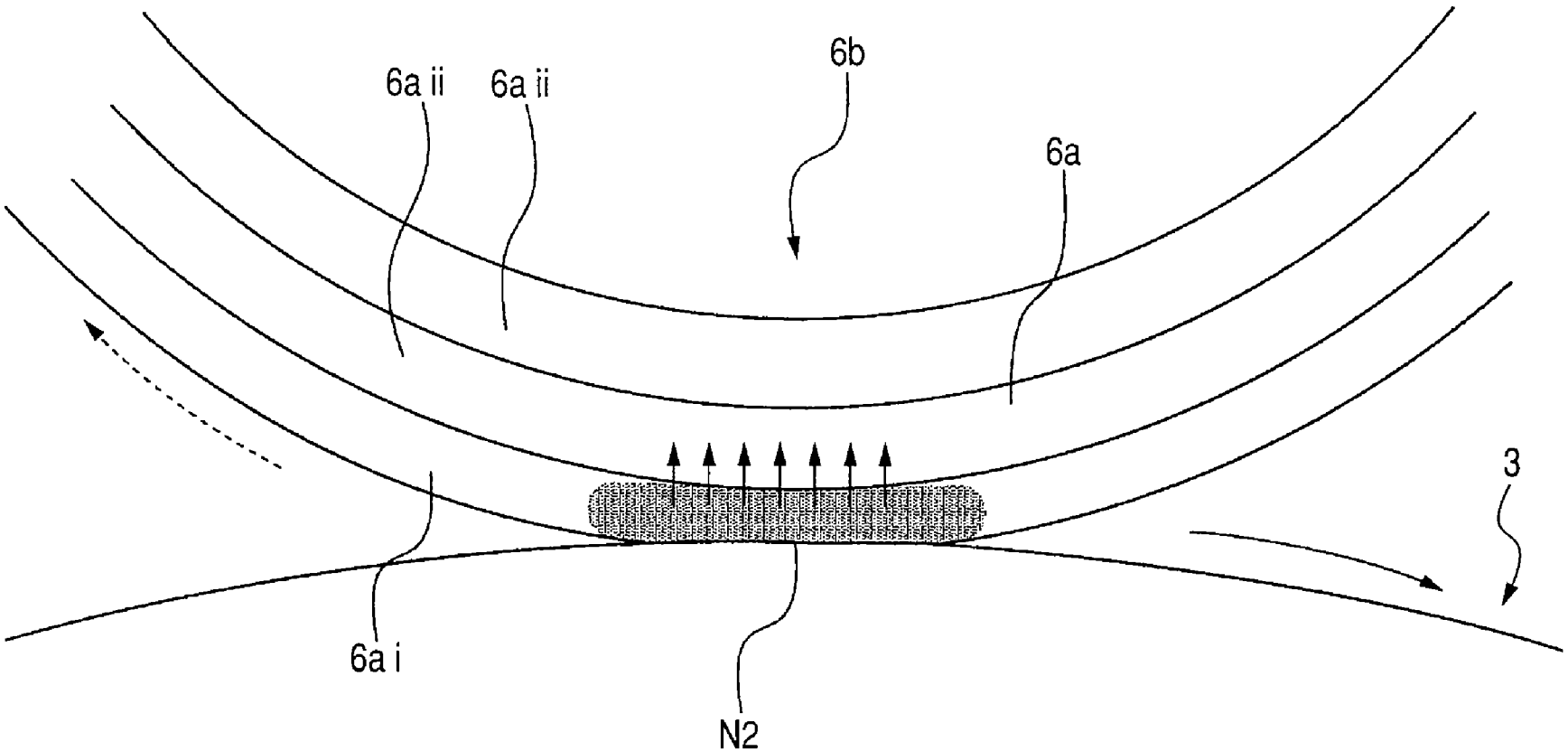
FIG. 6 is an enlarged view of the cleaning nip portion N2 of the image fixing apparatus according to Embodiment 1.

Things that can be known from the experiments are summarized. FIG. 6 is an enlarged view of the vicinity of the cleaning nip portion N2 of the image fixing apparatus 10. An outermost layer of the rolled-up web 6*a* is a surface layer web 6*ai*, layers thereof other than the surface layer are lower layer webs 6*aii*, and a hatched portion is the cleaning nip portion N2 formation area of the web 6*a*. It can be seen that when the cleaning nip portion N2 is constantly formed, heat is transferred from the pressure roller 3 to the cleaning nip portion N2 formation area of the web 6*a* and softens the toner component held inside the web, so that permeating (an upward arrow in the figure) of the toner component toward the lower layer web 6*aii* occurs.

On the other hand, when the fixing operation is continuously performed, although the cleaning nip portion N2 is always maintained at a temperature of about 120° C., due to the regular winding operation of the web 6*a*, the portion of the web at the cleaning nip portion N2 is changed. Accordingly, there is no situation in which heat is continuously transferred to the same part of the web 6*a*, so that permeating hardly occurs. That is, in the case where the state where the cleaning nip portion N2 is formed without changing the portion of the web at the cleaning nip portion N2, permeating of the toner component from the surface layer web 6*ai* in the cleaning nip portion N2 formation area toward the lower layer web 6*aii* occurs.

Therefore, the image fixing apparatus 10 separates the pressure roller 3 and the web 6*a* rolled up around the supplying roller 6*b* from each other using the separation mechanism to reduce heat transfer from the pressure roller 3 to the web 6*a*. That is, when cleaning is performed (during cleaning), the supplying roller 6*b* is at a cleaning position, and as illustrated by full lines of FIG. 3, the web 6*a* comes in contact with the pressure roller 3 to form the cleaning nip portion N2. On the other hand, when cleaning is not performed (during non-cleaning), the supplying roller 6*b* is displaced to a waiting position illustrated by dashed lines to separate the web 6*a* and the pressure roller 3 from each other. According to this embodiment, in the separation mechanism, a separation cam 6*f* is rotated by a motor (not illustrated) to change its angle and press the frame member 6*e* so as to rotate the cleaning unit 6 about the rotation shaft of the winding roller 6*c*, thereby displacing the supplying roller 6*b* to the waiting position illustrated by dashed lines. As the separation mechanism, any mechanism that can displace the supplying roller 6*b* to the waiting position and maintain the displaced state can be employed.

Figure 7:
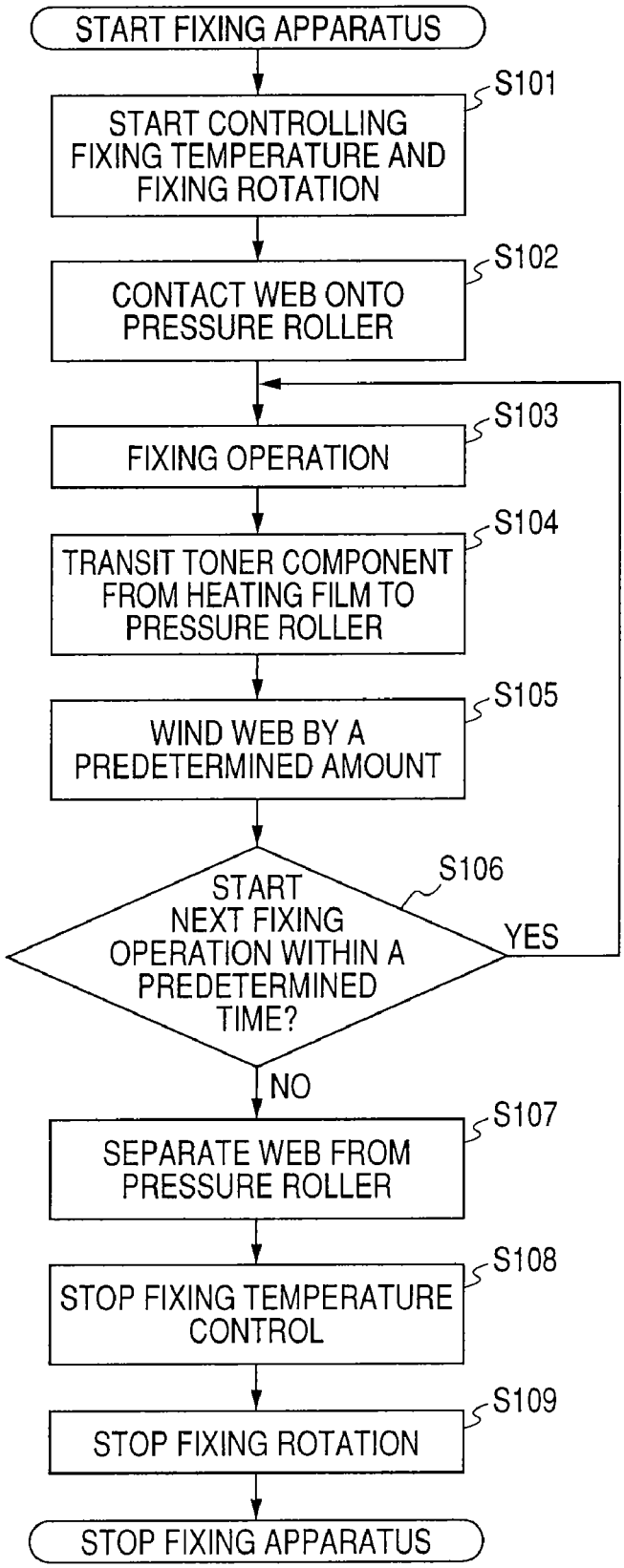
FIG. 7 is a flowchart of operations of the image fixing apparatus according to Embodiment 1.

The actual flow of a separation operation in the image forming apparatus using the image fixing apparatus 10 is configured by controlling each motor and the heater using a control circuit (not illustrated) such as a CPU in accordance with the flowchart of FIG. 7. When the image fixing apparatus 10 is started as the image forming apparatus is started, controlling the temperature to a target temperature for fixing depending on the material of the recording medium P (hereinafter, referred to as fixing temperature control) is started to drive the motor M1 and start rotation (hereinafter, referred to as fixing rotation) of the pressure roller 3 and the heating film 1*a* (S101). The separation cam 6*f* is rotated to move the supplying roller 6*b* to the cleaning position so as to allow the web 6*a* to contact onto the pressure roller 3, thereby forming the cleaning nip portion N2 (S102). The recording medium P on which a toner image is formed is transported to the fixing nip portion N1 so as to fix the toner image onto the recording medium P by applying heat and pressure (S103). The toner component adhering to the heating film 1*a* is transmitted to the pressure roller by the fixing operation with the rotation just after the recording medium P passes through the fixing nip portion N1 (S104). The toner component is held by the web 6*a* in the cleaning nip portion N2, and the web 6*a* is wound by a predetermined amount by rotating the motor M2 to change the portion of the web at the cleaning nip portion N2 (S105). In a case where the time (between pages) from the termination of one fixing operation to the start of the next fixing operation performed is equal to or less than a predetermined time (in this embodiment, 7 seconds), permeating hardly occurs, so that the separation operation is not allowed for every fixing operation in consideration of power consumption. On the other hand, in a case where the fixing operation is not performed for a predetermined time or longer, for example, when the apparatus is turned off and a job is terminated without a following job, or when time to read image data is needed, the separation is allowed (S106). In the case of the separation, the separation cam 6*f* is rotated to move the supplying roller 6*b* to the waiting position so as to separate the web 6*a* from the pressure roller 3 (S107), supplying electricity to the heater 2 is stopped to stop fixing temperature control (S108), and fixing rotation of the pressure roller 3 and the heating film 1*a* is stopped (S109).

In addition, in the image fixing apparatus 10, in order to remove the toner component adhering to the heating film 1*a*, the separation is not allowed until the pressure roller 3 is rotated at least once just after the recording medium P passes through the fixing nip portion N1.

Figure 8:
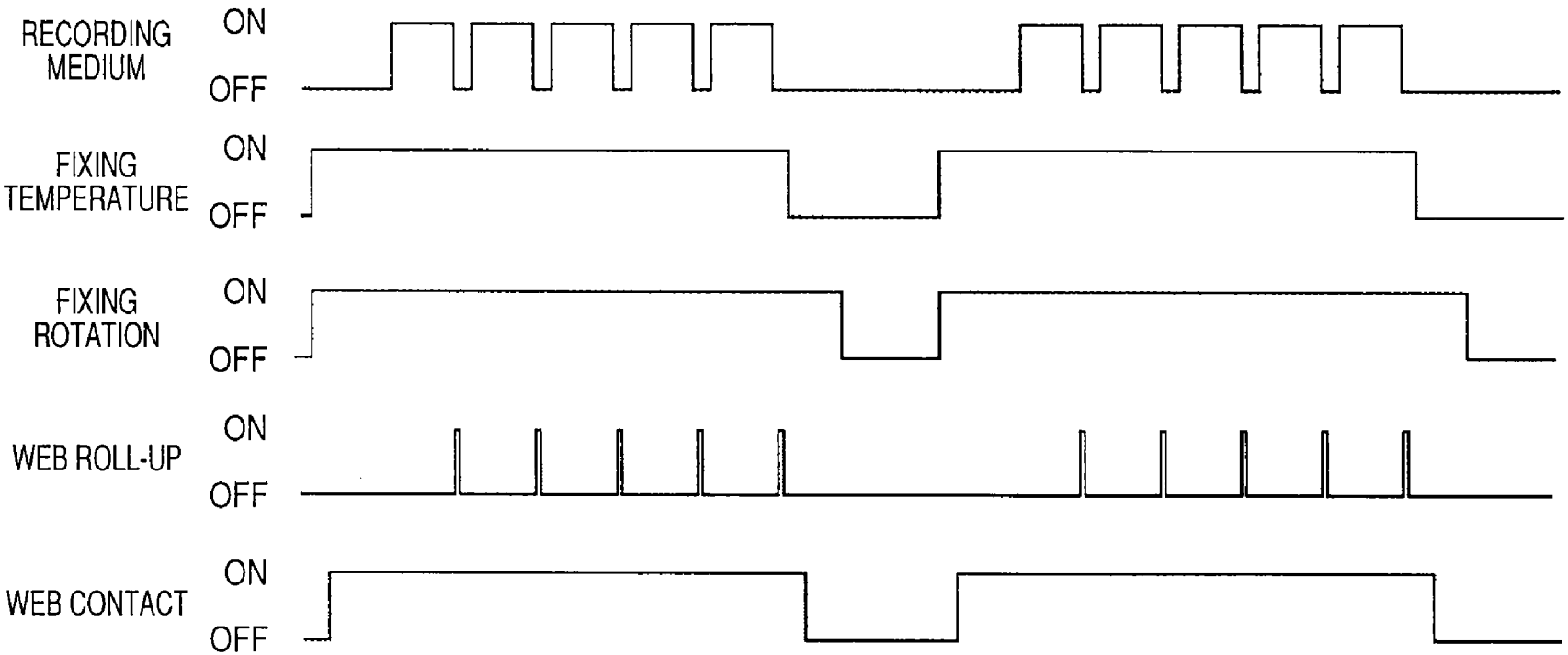
FIG. 8 is a timing chart of operations of the image fixing apparatus according to Embodiment 1.

FIG. 8 is a timing chart showing the control operation of the image fixing apparatus 10. When the recording medium is in an ON state, it means that the recording medium P is passing through the fixing nip portion N1, and when the recording medium is in an OFF state, it means that the recording medium P is not passing through the fixing nip portion N1. When the fixing temperature control is in an ON state, it means that the fixing temperature control is being performed, and when the fixing temperature control is in an OFF state, it means that the fixing temperature control is stopped. When the fixing rotation is in an ON state, it means that the fixing rotation is being performed, and when the fixing rotation is in an OFF state, it means that the fixing rotation is stopped. When web roll-up is in an ON state, it means that the web roll-up is being performed, and when the web roll-up is in an OFF state, it means that the web roll-up is stopped. When web contact is in an ON state, it means that the web 6*a* is contacting the pressure roller 3 to form the cleaning nip portion N2, and when the web contact is in an OFF state, it means that the web 6*a* and the pressure roller 3 are separated from each other. It can be seen by FIG. 8 that in the case where the fixing operation is not performed for a predetermined time or longer, the image forming apparatus is turned off, and the web 6*a* is separated to reduce heat transfer and applied pressure.

Comparison Experiment 1

Next, using the image fixing apparatus 10 of this embodiment and an image fixing apparatus (Comparative Example) which constantly forms a cleaning nip portion N2 without a separation mechanism, a comparison experiment on permeating of toner into a lower web was performed.

The comparison experiment was performed using an image forming apparatus that includes the image fixing apparatus and forms 20 sheets of images per minute (20 ppm). After 1000 sheets of images were continuously formed in a setting that forms a black halftone (50% density) image on an A4-size paper having a basic weight of 90 g/m$^2$ over the entire surface, the image fixing apparatus was cooled to a room temperature, thereby achieving a state where the image fixing apparatus 10 is generally used. Next, forming 5 sheets of images at 20 ppm for about 15 seconds in the first half of a one-set image formation operation and not forming any image for about 45 seconds in the last half of the one-set image formation operation, were performed as part of the one-set image formation operation that is performed for 60 seconds (so-called intermittent 5 sheets image formation) in the same setting. The winding length of the web 6*a* was 50 μm per one sheet of paper. In addition, in this embodiment, in order to perform the operations according to the flow chart shown in FIG. 7, a separation operation was performed for about 45 seconds in the last half of the intermittent 5 sheets image formation. Under the experimental condition as described above, contamination of the lower web 6*aii* of the cleaning nip portion N2 after starting the intermittent 5 sheets image formation was observed. A case where permeating had not completely occurred was denoted by I, a case where permeating could be seen was denoted by II, and a case where permeating occurred as sticking between the webs was illustrated was denoted by III. The result is illustrated in Table 1.

According to this embodiment, permeating had not occurred even when 160 sheets of images (32 sets) were formed. On the other hand, in Comparative Example, permeating occurred when 20 sheets of images (4 sets) were formed, and sticking was confirmed when 40 sheets of images (8 sets) were formed. In addition, in the Comparative Example, when the image fixing apparatus was cooled to room temperature in the state where the sticking occurred and the image formation is then re-performed, a part of the web 6*a* was broken as the web was wound. This was because the surface layer web 6*ai* and the lower layer web 6*aii* were stuck together by the toner component held by the surface layer web 6*ai*.

TABLE 1

| | Image Formation Sheets | | | | | |
|---|---|---|---|---|---|---|
| | 0 | 10 | 20 | 40 | 80 | 160 |
| Embodiment | I | I | I | I | I | I |
| Comparative Example | I | I | II | III | III | III |

Figure 9:
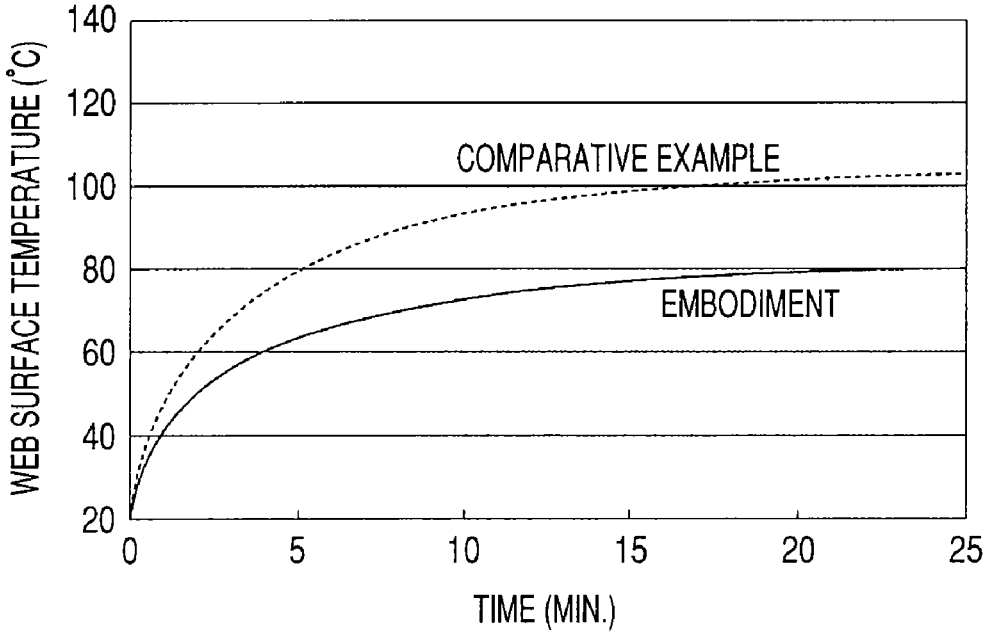
FIG. 9 is a diagram illustrating a relationship between a paper passing time (minute) and a surface temperature of a web.

FIG. 9 illustrates time-varying temperatures (web surface temperatures) of the cleaning nip portion N2 formation areas of the webs 6*a* of the embodiment and the Comparative Example in the comparison experiment 1. A paper passing time is a time after starting the intermittent 5 sheets image formation. In the embodiment, since the separation was allowed, the temperature reached equilibrium at approximately 80° C. On the other hand, in the Comparative Example, the temperature increased to 100° C. or higher, and it can be seen that the temperature increased higher than the glass-transition temperature of the toner component held in the surface layer web 6*aii* of the cleaning nip portion N2 formation area by a significant amount so that the fluidity of the toner component increased.

Figure 10:
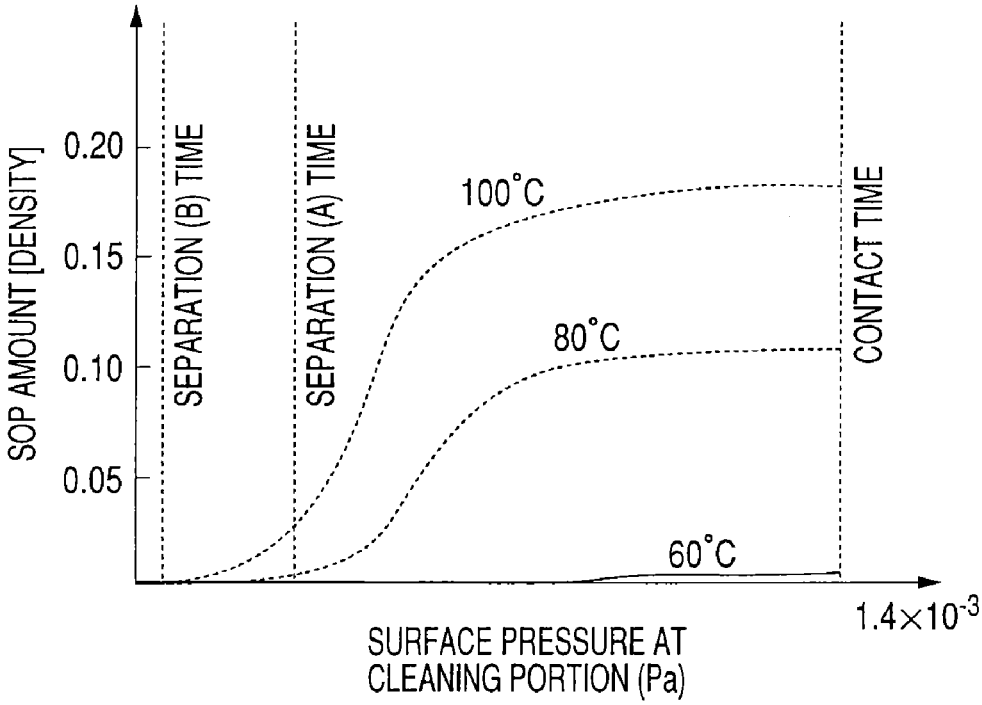
FIG. 10 is a diagram illustrating a relationship between a surface pressure at a cleaning portion and a permeation amount.

FIG. 10 illustrates a change in a permeation amount with a change in a surface pressure (cleaning portion surface pressure) between the surface layer web 6*ai* and the lower layer web 6*aii* in the cleaning nip portion N2 formation area of the image fixing apparatus 10 of this embodiment. Permeation amounts in case where the web temperature at each surface pressure was maintained at 60° C., 80° C., and 100° C. were measured for 30 minutes. When the permeation amounts during contacting (during the cleaning nip portion N2 formation) and during separation (A) in which the surface pressure at that time is lower than that during the cleaning nip portion N2 formation (during separation) are compared to each other, it can be seen that when the surface pressure is reduced by the separation, permeating hardly occurs.

It is thought that in the Comparative Example, heat was transferred to the pressure roller 3, the temperature of the surface layer web 6*ai* of the cleaning nip portion N2 formation area had increased higher than the glass-transition temperature by a significant amount, and the surface layer web 6*ai* was nipped and pressurized in the cleaning nip portion N2, so that permeating occurred.

According to this embodiment, it is possible to reduce permeating of the toner component held by the surface layer web 6*ai* of the supplying roller 6*b* into the lower layer web 6*aii*. In addition, according to this embodiment, it is possible to prevent the surface layer web 6*ai* and the lower layer web 6*aii* of the supplying roller 6*b* from sticking together. Furthermore, according to this embodiment, the position of the rotation shaft of the winding roller 6*c* which is driven by the motor M2 can be set to the same position without depending on the separation or contacting operation, so that the image fixing apparatus can be further simplified.

Embodiment 2

Figure 11:
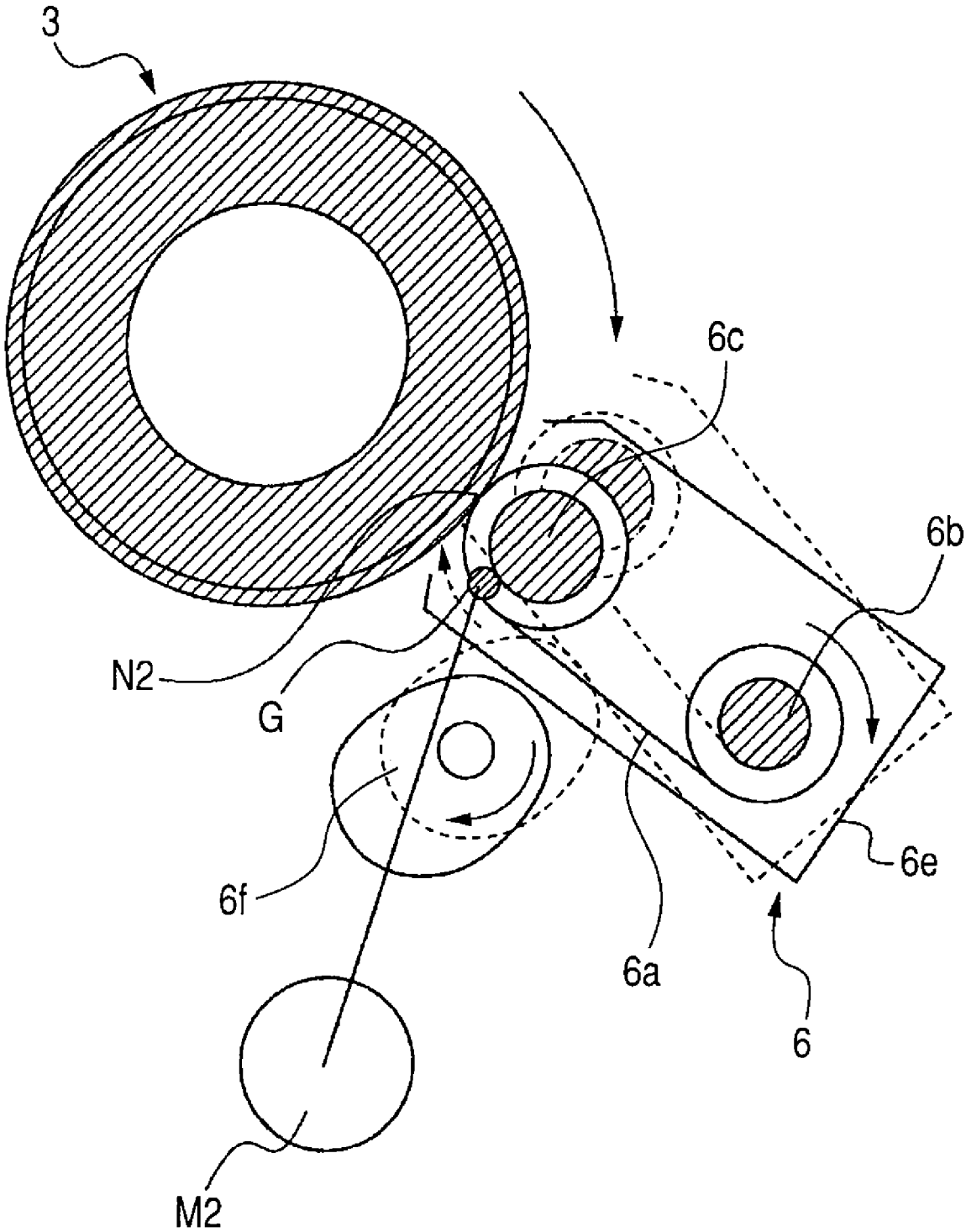
FIG. 11 is a sectional view of the cleaning unit of the image fixing apparatus according to Embodiment 2.

As illustrated in FIG. 11, the cleaning unit 6 of the image fixing apparatus 10 of this embodiment has a configuration in which the winding roller 6*c*, instead of the supplying roller 6*b*, contacts the pressure roller 3 to form the cleaning nip portion N2. That is, the winding roller 6*c* is displaced at a cleaning position during cleaning and displaced at a waiting position during non-cleaning, and other features are the same as those of Embodiment 1, so that detailed description thereof will be omitted.

In this embodiment, the winding roller 6*c* is driven by the motor M2 via the idle gear G in a dashed arrow direction. During separation, power transmission to the winding roller 6*c* and the idle gear G is intercepted.

In the case where the winding roller also serves as the contact roller as in this embodiment, when the winding roller always comes in contact to form the cleaning nip portion N2, the toner component is exuded from the lower layer web 6*aii* of the web 6*a* rolled up around the winding roller 6*c* toward the surface layer web 6*ai*. That is, the toner component held by the lower layer web 6*aii* near the cleaning nip portion N2 is exuded toward the cleaning nip portion N2 formation area or the unused portion for cleaning of the surface layer web 6*ai* due to the heat of the pressure roller 3 and the pressure in the cleaning nip portion N2. This causes degradation of the cleaning ability of the web 6*a*.

Comparison Experiment 2

A comparison experiment for comparing the embodiment that allows contact and separation to an embodiment that only allows contact was performed. A comparative example in which the cleaning nip portion N2 was formed without operating the separation mechanism of the image fixing apparatus 10 of this embodiment was used. The experimental condition was set to be the same as the comparison experiment 1, and in this experiment, discharge of the recording medium P was observed. A case of no discharge was denoted by I, a case where a discharge that could be barely seen was confirmed was denoted by II, and a case where discharge could be easily confirmed was denoted by III. The result is illustrated in Table 2.

TABLE 2

| | Image Formation Sheets | | | | | |
|---|---|---|---|---|---|---|
| | 0 | 10 | 20 | 40 | 80 | 160 |
| Embodiment | I | I | I | I | I | I |
| Comparative Example | I | I | I | II | III | III |

In this embodiment, cleaning malfunction or discharge had not occurred even when 160 sheets of images (32 sets) were formed. On the other hand, in the Comparative Example, cleaning malfunction or discharge had occurred after 40 sheets of images (8 sets) were formed. In addition, when the cleaning nip portion N2 was observed after terminating the experiment, in this embodiment, exuding had not occurred. However, in the Comparative Example, exuding of the toner component held by the lower layer web 6*aii* into the surface layer web 6*ai* was observed. Furthermore, with the exuding, from when 80 sheets of images were formed, variants occurred due to the toner component layer held by the web 6*a* and friction and vibration on the surface of the pressure roller 3.

It is thought that in the Comparative Example, the heat was transferred from the pressure roller 3 to the lower layer web 6*aii* near the cleaning nip portion N2, the toner component held therein had softened and the fluidity of the toner component had increased, and the toner component was constantly applied with the pressure in the cleaning nip portion N2, resulting in the exuding of the toner component.

According to this embodiment, it is possible to suppress the toner component held by the lower layer web 6*aii* of the winding roller 6*c* from exuding into the surface layer web 6*ai*.

Embodiment 3

Another embodiment different from Embodiments 1 and 2 will be described. Accordingly, a description of common parts of Embodiments 1 and 2 will be omitted. In order for the cleaning unit 6 of the image fixing apparatus 10 of this embodiment to enhance the cleaning ability, the cleaning nip portion N2 is lengthened in the winding direction of the web 6*a*.

Figure 12B:
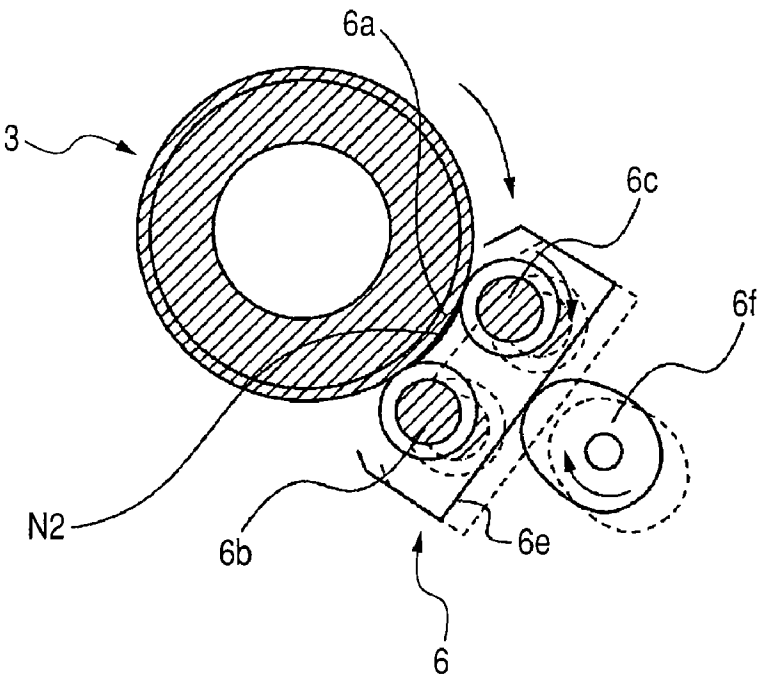
FIG. 12B is a sectional view of the cleaning unit of the image fixing apparatus according to Embodiment 3, the cleaning unit including a supplying roller and a winding roller that both serve as contact rollers.
Figure 12A:
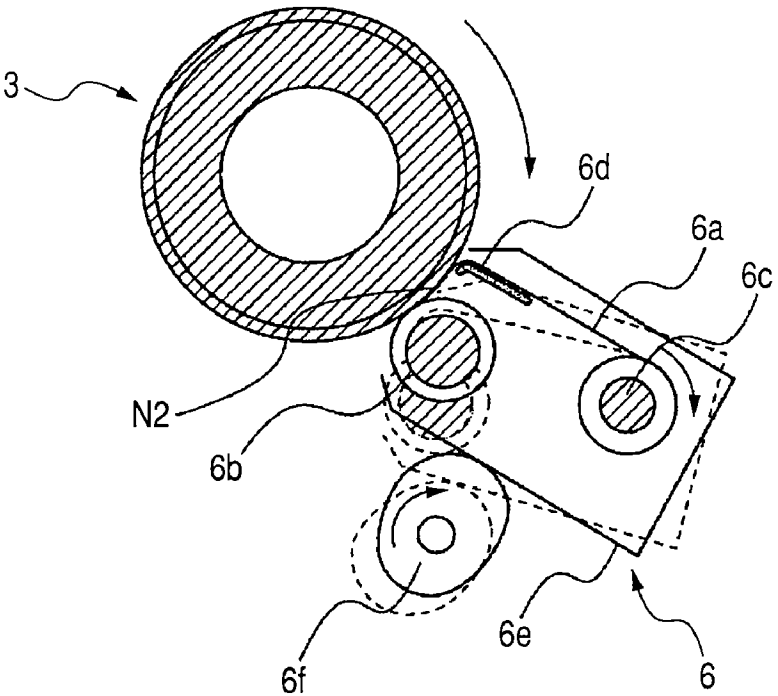
FIG. 12A is a sectional view of the cleaning unit of the image fixing apparatus according to Embodiment 3, the cleaning unit allowing a web to be wound around a winding roller via a web winding member from a supplying roller.

In FIG. 12A, the cleaning unit 6 is configured to wind the web 6*a* around the winding roller 6*c* from the supplying roller 6*b* via a web winding member 6*d*. In this embodiment, the supplying roller 6*b* and the web winding member 6*d* are displaced at cleaning positions during cleaning and displaced at waiting positions during non-cleaning. The displacement to the waiting positions in this embodiment is performed by rotating the separation cam 6*f* during the separation and rotating the cleaning unit 6 until a state illustrated by dashed lines in the figure as in Embodiment 1. According to this embodiment, it is possible to prevent the toner component held by the surface layer web 6*ai* of the supplying roller 6*b* from permeating into the lower layer web 6*aii* by widening the cleaning nip portion N2. In addition, it is possible to prevent the surface layer web 6*ai* and the lower layer web 6*aii* of the supplying roller 6*b* from sticking together.

In FIG. 12B, the cleaning unit 6 is configured so that both the supplying roller 6*b* and the winding roller 6*c* serve as contact rollers. In this embodiment, the supplying roller 6*b* and the winding roller 6*c* are displaced at cleaning positions during cleaning and are displaced at waiting positions during non-cleaning. The displacement to the waiting positions in this embodiment is performed by rotating the separation cam 6*f* to displace the cleaning unit 6 to a state illustrated by dashed lines and displace the supplying roller 6*b* and the winding roller 6*c* to the waiting positions. According to this embodiment, it is possible to prevent the toner component held by the surface layer web 6*ai* of the supplying roller 6*b* from permeating into the lower layer web 6*aii* by widening the cleaning nip portion N2. In addition, it is possible to prevent the surface layer web 6*ai* and the lower layer web 6*aii* of the supplying roller 6*b* from sticking together. Furthermore, it is possible to prevent the toner component held by the lower layer web 6*aii* of the winding roller 6*c* from exuding into the surface layer web 6*ai*.

Embodiment 4

Figure 13:
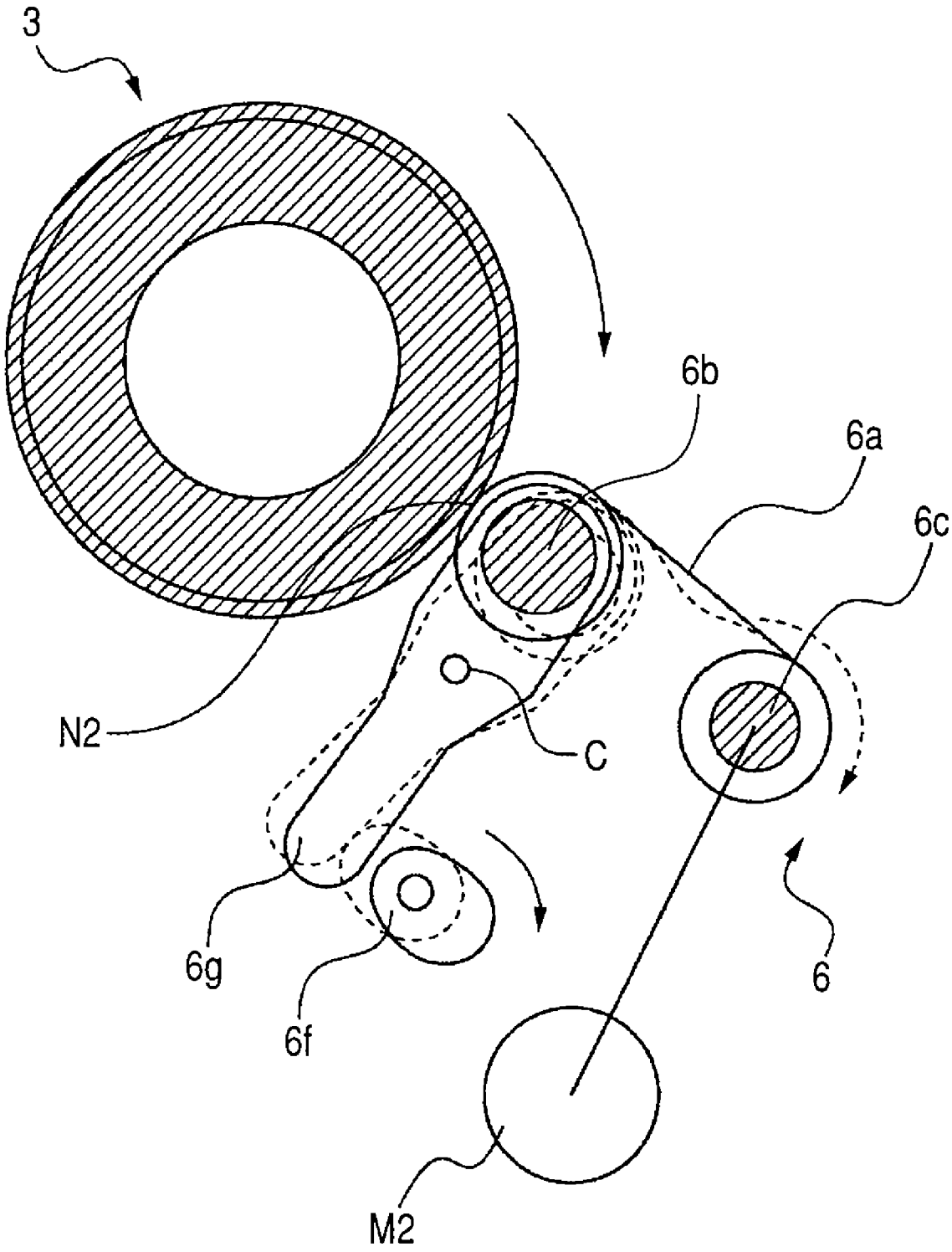
FIG. 13 is a sectional view of the cleaning unit of the image fixing apparatus according to Embodiment 4.

FIG. 13 illustrates the cleaning unit 6 of the image fixing apparatus 10 according to this embodiment. Since only the separation mechanism is different from that of Embodiment 1 and other features are common, a detailed description thereof will be omitted.

In this embodiment, the supplying roller 6*b* is supported by a pressure lever 6*g*. The supplying roller 6*b* is displaced to a waiting position by rotating the separation cam 6*f* to rotate the pressure lever 6*g* around an origin C so as to separate the web 6*a* and the pressure roller 3 from each other. A non-cleaning state is illustrated by dashed lines in the figure. The waiting position of this embodiment is a position at which the supplying roller 6*b* is closer to the winding roller 6*c* (second roller) than that at a cleaning position. Accordingly, the web 6*a* that is stretched between the two rollers during cleaning is loosened during non-cleaning. As described above, in this embodiment, during non-cleaning, the web 6*a* between the supplying roller 6*b* and the winding roller 6*c* is loosened (looseness separation).

During the looseness separation, the tension of the web 6*a* during the separation can be released, so that the surface pressure between the surface layer web 6*ai* and the lower layer web 6*aii* of the cleaning nip portion N2 can further be reduced. As illustrated in FIG. 10, when the separation (B) that is the looseness separation of this embodiment is compared to the separation (A) without looseness, it can be seen that permeating of the toner component can further be suppressed with the decrease in the surface pressure.

According to this embodiment, since the looseness separation is performed, the surface pressure between the surface layer web 6*ai* and the lower layer web 6*aii* of the cleaning nip portion N2 formation area is decreased further than that during the separation without the looseness. Therefore, it is possible to further suppress the permeating of the toner component into the lower layer web 6*aii*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-059557, filed Mar. 12, 2009, which is hereby incorporated by reference herein in its entirety.

What is claimed is:

1. An image fixing apparatus for fixing an unfixed toner image formed on a recording medium, comprising:

a cylindrical fixing film;

a heater which comes in contact with an inside surface of the fixing film;

a fixing rotation member that forms a fixing nip portion through which the recording medium passes together with the heater through the fixing film, the fixing rotation member not having a heat source therein, wherein when the recording medium is not in the fixing nip portion, a toner component adhering to the fixing film is transmitted to the fixing rotation member; and a roller having a peripheral surface around which a web is wound, the roller forming a cleaning nip portion for cleaning the toner component from the fixing rotation member with the web by pressing a portion on which the web is winded up, against the fixing rotation member, wherein a used portion of the web previously used for cleaning of the fixing rotation member moves from the cleaning nip portion by rotation of the roller, and wherein during non-cleaning in which the web does not clean the fixing rotation member, the roller is displaced away from the fixing rotation member to a position that is farther away from the fixing rotation member than the position of the roller during cleaning of the fixing rotation member by the web, so that the roller separates from the fixing rotation member.

2. An image fixing apparatus according to claim 1, wherein the roller is a supplying roller on which an unused portion for cleaning of the web is wound up, and the supplying roller supplies the unused portion for cleaning of the web to the cleaning nip portion.

3. An image fixing apparatus according to claim 1, wherein the roller is a winding roller for winding the used portion for cleaning of the web from the cleaning nip portion.

4. An image fixing apparatus according to claim 1, further comprising a second roller having a peripheral surface around which the web is wound, wherein the web is stretched between the roller and the second roller, and wherein when the web is separated from the fixing rotation member during non-cleaning, the web is loosened between the roller and the second roller.

5. An image fixing apparatus according to claim 4, wherein a position of the roller during non-cleaning is a position at which the roller is closer to the second roller than a position during the cleaning so as to allow the web to loosen between the roller and the second roller.

6. An image fixing apparatus according to claim 1, wherein a state where the web wound up on the roller is pressed on the fixing rotation member is maintained until the fixing rotation member is rotated at least once after the recording medium passes through the fixing nip portion.

7. An image fixing apparatus according to claim 1, wherein in a case where a time until a next recording medium passes through the fixing nip portion after the recording medium passes through the fixing nip portion is shorter than a predetermined time, a state where the web wound up on the roller is pressed on the fixing rotation member is maintained at a time interval until the next recording medium reaches the fixing nip portion.

8. An image fixing apparatus for fixing an unfixed toner image formed on a recording medium, comprising:

a fixing rotation member that forms a fixing nip portion through which the recording medium passes; and a roller having a peripheral surface around which a web is wound, the roller forming a cleaning nip portion for cleaning the fixing rotation member with the web by pressing a portion on which the web is winded up, against the fixing rotation member, wherein a used portion of the web previously used for cleaning of the fixation rotation member by the web moves from the cleaning nip portion by rotation of the roller, wherein during non-cleaning in which the web does not clean the fixing rotation member, the roller is displaced away from the fixing rotation member to a position that is farther away from the fixing rotation member than the position of the roller during cleaning of the fixation rotation member, so that the web separates from the fixing rotation member, and wherein a state where the web wound up on the roller is pressed on the fixing rotation member is maintained until the fixing rotation member is rotated at least once after the recording medium passes through the fixing nip portion.

9. An image fixing apparatus for fixing an unfixed toner image formed on a recording medium, comprising:

a fixing rotation member that forms a fixing nip portion through which the recording medium passes; and a roller having a peripheral surface around which a web is wound, the roller forming a cleaning nip portion for cleaning the fixing rotation member with the web by pressing a portion on which the web is winded up, against the fixing rotation member, wherein a used portion of the web previously used for cleaning of the fixation rotation member by the web moves from the cleaning nip portion by rotation of the roller, wherein during non-cleaning in which the web does not clean the fixing rotation member, the roller is displaced away from the fixing rotation member to a position that is farther away from the fixing rotation member than the position of the roller during cleaning of the fixation rotation member, so that the web separates from the fixing rotation member, and wherein in a case where a time until a next recording medium passes through the fixing nip portion after the recording medium passes through the fixing nip portion is shorter than a predetermined time, a state where the web wound up on the roller is pressed on the fixing rotation member is maintained at a time interval until the next recording medium reaches the fixing nip portion.

* * * * *